US006925137B1

(12) United States Patent
Forman

(10) Patent No.: US 6,925,137 B1
(45) Date of Patent: Aug. 2, 2005

(54) SMALL NEUTRON GENERATOR USING A HIGH CURRENT ELECTRON BOMBARDMENT ION SOURCE AND METHODS OF TREATING TUMORS THEREWITH

(76) Inventor: Leon Forman, 52 Pardam Knoll Rd., Miller Place, NY (US) 11764

( * ) Notice: Subject to any disclaimer, the term of this patent is extended or adjusted under 35 U.S.C. 154(b) by 0 days.

(21) Appl. No.: 09/677,630

(22) Filed: Oct. 3, 2000

Related U.S. Application Data

(60) Provisional application No. 60/157,507, filed on Oct. 4, 1999.

(51) Int. Cl.[7] ..... G21G 1/10

(52) U.S. Cl. ..... 376/190; 376/108; 376/114; 376/110; 376/158; 250/423

(58) Field of Search ..... 376/190, 108, 376/114, 110, 158, 109; 250/423; 600/1

(56) References Cited

U.S. PATENT DOCUMENTS

| | | | | |
|---|---|---|---|---|
| 3,546,512 A | * | 12/1970 | Frentrop | 313/155 |
| 3,786,258 A | * | 1/1974 | Schmidt | 376/115 |
| 3,816,785 A | * | 6/1974 | Miller | 376/151 |
| 4,529,571 A | * | 7/1985 | Bacon et al. | 376/144 |
| 5,215,703 A | * | 6/1993 | Bernardet | 376/114 |
| 5,293,410 A | * | 3/1994 | Chen et al. | 376/108 |
| 5,745,537 A | * | 4/1998 | Verschoore | 376/108 |
| 6,141,395 A | * | 10/2000 | Nishimura et al. | 250/301 |
| 6,297,507 B1 | * | 10/2001 | Chen et al. | 250/269.1 |

OTHER PUBLICATIONS

Reifenschweiler, "Neutrons from Small Tubes—Philipps Tube: Continuous of Pulsed Operation," Nucleonics, vol. 18, No. 12–Dec. 1960, pp. 69–71.*

* cited by examiner

*Primary Examiner*—Michael J. Carone
*Assistant Examiner*—R Palabrica
(74) *Attorney, Agent, or Firm*—Galgano & Burke, LLP

(57) ABSTRACT

A neutron generator includes a modular arrangement of a high current electron bombardment ion source, providing deuterium(D) and/or tritium(T) ions, a high voltage acceleration stage to accelerate the ions and raise the ion energy to the order of 100 keV, and an occluded reaction target containing T and/or D to produce the nuclear reactions. Neutrons are produced in the target using the D—D and/or D-T reaction. The invention is designed to allow the target to be located at the end of a needle and thereby is useful for treating cancers by the Brachy therapy method. The ion source of the neutron generator is a modified version of the electron bombardment type used in mass spectrometers for gas analysis. This source uses an electron beam running through an ionization chamber to ionize gas molecules that are extracted out of the chamber by electric fields. The ion source has been redesigned for higher current by providing a larger electron beam and enlarging the extraction slit and subsequent focusing element apertures to 3 mm or more. This modified source provides microamperes of ion current at operating pressures in the $10^{-4}$ torr range, whereas a typical mass spectrometer source for radio frequency instruments (0.1 mm extraction orifice), produces many decades lower output. An embodiment particularly suited for treating tumors as well as methods for using it are disclosed.

10 Claims, 6 Drawing Sheets

PORTABLE NEUTRON GENERATOR FOR FIELD USE

SMALL NEUTRON GENERATOR USING A HIGH CURRENT ELECTRON BOMBARDMENT ION SOURCE AND METHODS OF TREATING TUMORS THEREWITH

This application claims the benefit of provisional application Ser. No. 60/157,507 filed Oct. 4, 1999.

BACKGROUND OF THE INVENTION

1. Field of the Invention

The invention relates to apparatus and methods for delivery of neutron beams for medical therapy. More particularly, the invention relates to a small neutron generator using a high current electron bombardment ion source and methods of treating tumors therewith.

2. State of the Art

Application of neutrons for radiotherapy of cancer has been a subject of considerable clinical and research interest since the discovery of the neutron by Chadwick, in 1932. Fast neutron radiotherapy was first used by Robert Stone in the Lawrence Berkeley Laboratory in 1938.

This technology has evolved over the years to the point where it is now a reimbursable modality of choice for inoperable salivary gland tumors, and it is emerging, on the basis of recent research data, as a promising alternate modality for prostate cancer, some lung tumors, and certain other malignancies as well.

Neutron generators presently used in neutron therapy comprise either a particle accelerator (tandem or proton linear cyclotron), which bombards a beryllium target with its particles (protons or deuterium nuclei called deuterons) of energy between 15 and 60 MeV, or a particle accelerator, which bombards a tritiated target of deuterons of 75 to 500 KeV, or which bombards a hydrogenatable metal target (occluded "autotarget", this target being regeneratable) with a mixture of deuterons and tritium nuclei (called tritons) of 75 to 500 KeV, so as to produce neutrons of energy equal to 14 MeV, which are very effective in neutron therapy. The process is referred to as the DT reaction. Also, neutrons of energy equal to 2.5 MeV are produced when 75–500 KeV deuterons strike deuterium atoms in the target. The process is referred to as the DD Reaction.

A typical prior art neutron generator for neutron therapy uses a plasma discharge source, Penning ionization gauge, capable of developing milli-amperes of ion current. High voltage is typically 100 KeV, resulting in target power dissipation on the order of 100 watts. Dose at 1 meter from the target can be 100 rem/hr which requires considerable radiation protection measures for operation in a laboratory or medical treatment facility.

Considerable work has also been carried out for development of thermonuclear plasma type neutron sources. These devices have relatively large chambers, 10's of cm in radius, to contain the reactant gas, and require relatively large power sources per neutron produced, because the relative energy difference of the particles is low compared with 120 keV which is the peak of the cross section for the DT reaction.

Prior art neutron therapy systems are largely located only at major research centers since they are physically complex, bulky, and require high-level operating staffs to maintain. In general these systems are not well suited for wide-spread, practical, clinical deployment. Moreover, due to their substantial power requirements, none of these systems are suitable for field use.

Recently, there have been advances in brachytherapy, i.e. radiation therapy where a neutron source is placed in contact with the tumor. The procedures most frequently used involve the implantation of radioactive "seeds" which are delivered to the treatment site with hollow needles. One of the most promising neutron sources for brachytherapy is Californium-252. Californium-252 sources are unique in providing a high intensity source of neutrons in a compact and portable package. The operational and safety requirements of Cf-252 sources are onerous.

Clinical research with Cf-252 neutron brachytherapy has been hampered by radiation safety difficulties, including source handling, source transport, staff and area monitoring and shielding. The complex regulatory and shielding requirements alone are enough to discourage university hospitals and clinics from implementing Cf-252 brachytherapy and participating in this important area of clinical research. Theoretical understanding of the research is complicated by the fact that Cf-252 neutrons are produced in a broad energy spectrum, with 40% of the dose from fission gamma rays. If neutron brachytherapy is dramatically successful, it is not clear whether the world supply of Cf-252 (produced in high flux reactors) will be capable of meeting the demand from thousands of treatment centers throughout the world.

Although radioactive seed therapy may be a significant improvement over therapy which uses large neutron generators, it does have drawbacks. In addition to the issues discussed above, it is still a surgical procedure which requires high skill and a controlled environment. Implanting and subsequently removing the seeds is a very meticulous task.

SUMMARY OF THE INVENTION

It is therefore an object of the invention to provide methods for treating tumors which overcome the disadvantages of the existing methods.

It is also an object of the invention to provide methods for treating tumors which can be performed outside of a large hospital, e.g. in a clinic.

It is another object of the invention to provide methods for treating tumors which can be performed in the field.

It is still another object of the invention to provide methods for treating tumors which do not require major surgery with general anesthesia.

It is also an object of the invention to provide an apparatus for treating tumors with neutron therapy.

It is also an object of the invention to provide an apparatus for treating tumors with neutron therapy which can be used outside of a large hospital, e.g. in a clinic.

It is another object of the invention to provide an apparatus for treating tumors with neutron therapy which can be used in the field.

It is still another object of the invention to provide an apparatus for treating tumors with neutron therapy which does not require a surgical procedure.

It is another object of the invention to provide a small neutron generator which is relatively portable and does not require a large amount of power.

In accord with these objects which will be discussed in detail below, the neutron generator of the present invention includes a modular arrangement of a high current electron bombardment ion source , providing deuterium(D) and/or tritium(T) ions, a high voltage acceleration stage to accelerate the ions and raise the ion energy to the order of 100 keV, and an occluded reaction target containing T and/or D to produce the nuclear reactions. Neutrons are produced in the target using the D—D and/or D-T reaction.

According to the invention, the ion source of the neutron generator is a modified version of the electron bombardment type used in mass spectrometers for gas analysis. The electron bombardment source used here is manufactured by Veeco Instruments, Plainview, New York for their models MS 20, MS 40, and MS 50 Mass Spectrometeric Tubes. This source uses an electron beam running through an ionization chamber to ionize gas molecules that are extracted out of the chamber by electric fields. According to the invention, the ion source has been redesigned for higher current by providing a larger electron beam and enlarging the extraction slit and subsequent focusing element apertures to 3 mm or more. This modified source can provide microamperes of ion current at operating pressures in the $10^{-4}$ torr range, whereas a typical mass spectrometer source for radio frequency instruments (0.1 mm extraction orifice), produces many decades lower output.

Two embodiments of accelerator of the invention are disclosed. The first is a simple neutron generator where an ion beam is accelerated into a planar target. The second neutron generator is specifically designed for tumor treatment where the beam is accelerated into a needle where the target is located at the end of the needle. The accelerator portion of the simple neutron generator includes the exit slit of the ion source, a field free region to allow the ion beam to diverge to the appropriate size (when needed), and a planar target at negative potential relative to the ion exit slit. In the second embodiment, the needle is a few cm diameter located at "L" cm from the source. The electric field lines tend to focus the source angular divergence at the entrance to the highly negative needle voltage in both the y and z directions. In the field free region inside the needle, the beam diverges until it reaches the target at the end of the needle. When the length of the needle is less than "L" cm, the beam is smaller than the source output x and y dimensions and the beam can be scanned along the target by relatively low voltage source steering plates. When the length of the needle is greater than "L", L can be chosen for a beam that fills the target; for a source exit slit of 3 mm×10 mm located Scm from the needle, an "L" length of 10 cm will reasonably illuminate a lcm radius target.

An advantage of the modular ion source of the invention is that it can be operated at relatively low voltages. For example, the electron beam used for ionization is derived from a filament which requires 15 watts or so at 3 volts which can be supplied easily with low voltage technology. Steering of the beam in the source is accomplished with about +/−10 volts range, requiring a field free region of 5 cm to achieve about +/−5 mm range for a 300 volt anode voltage, accessible from digital to analog converters and therefore can be programmed by PC technology for beam sweeping along the target to optimize dose for tumor treatment. The source can be floated at high potential when it is desired to operate the target at ground potential. A modular accelerator stage can be designed for focusing the ion beam onto a narrow spot for scanning, or, produce a beam equal to the target area for simply producing neutrons at low current density. The power requirement for the accelerator module can be less than 1 watt. The modular target can be placed close to the vacuum housing, as required for tumor treatment, or at any convenient location. This approach provides an efficient, low cost, low power, and light weight neutron source for applications in nondestructive analysis, medicine, and other fields requiring neutron production rates of $10^6$–$10^8$ neutrons/sec.

Methods for treating tumors with the invention are disclosed where dosages are calculated using Monte Carlo techniques. The methods also include the use of different focusing grids, different needle sizes, and different target shapes for treating tumors of different size, shape, and depth. According to other methods of the invention, fractionated doses are provided at different angles to the tumor. For some treatment methods, the needle need not pierce the skin but only needs to be located adjacent to the skin area under which the tumor lies. For other treatment methods, the needle is inserted through the skin and into the tumor below the skin.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
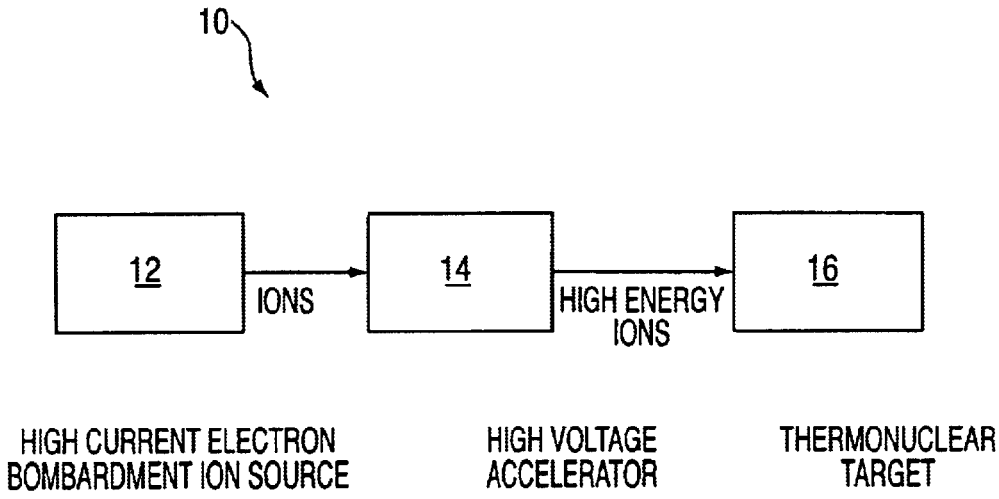
FIG. 1 is a high level schematic diagram of a neutron generator according to the invention.

Referring now to FIG. 1, the neutron generator 10 of the present invention includes a modular arrangement of a high current electron bombardment ion source 12, providing deuterium(D) and/or tritium(T) ions, a high voltage acceleration stage 14 to accelerate the ions and raise the ion energy to the order of 100 kev, and an occluded reaction target 16 containing T and/or D to produce the nuclear reactions. Neutrons are produced in the target using the DD and/or DT reaction.

Figure 2:
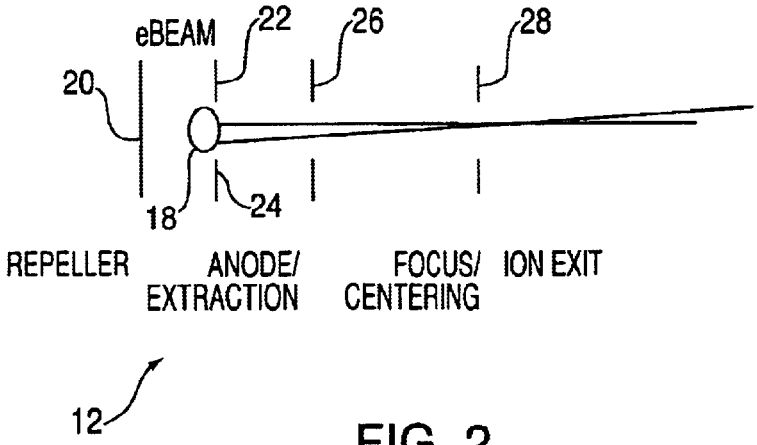
FIG. 2 is a high level schematic diagram of the ion generator portion of the neutron generator of FIG. 1.

Turning now to FIG. 2, according to the invention, the ion source 12 of the neutron generator is a modified version of the electron bombardment type used in mass spectrometers for gas analysis; the original ion source 18 manufactured by Veeco Instruments with 1 mm slits. This source uses an electron beam 18 running through an ionization chamber (region between the repeller 20 and the anode 22) to ionize gas molecules that are extracted out of the chamber by electric fields. The ionization chamber contains hydrogen isotope gas. The electron beam traverses the region and creates ions by collisions with the gas. The energy of the electron beam may be controlled to produce the highest current of D+ or T+ ions since the single atomic species provides a higher probability of thermonuclear interaction than the molecular species. Ions created in the ionization region are extracted by a penetrating electric field through the anode slit 24 reinforced by the electric field of the repeller, at slightly more positive potential than the anode, which repels ions toward the anode. Focus plates 26 accelerate and focus the ions toward the ion exit 28 and may be separately controlled for steering the ion stream. According to the invention, the dimensions of the ion exit 28 are 3 mm or greater. According to the invention, the ion source 12 has also been redesigned for higher current by providing a larger electron beam 18 through a focusing grid. This modified source can provide microamperes of ion current at operating pressures in the $10^{-4}$ torr range, whereas a typical mass spectrometer source for radio frequency instruments (0.1 mm extraction orifice), produces many decades lower output. Steering of the beam is preferably accomplished by "rasterizing" the beam as with a CRT display. Thus, the beam can be controlled to trace any shape.

Figure 3:
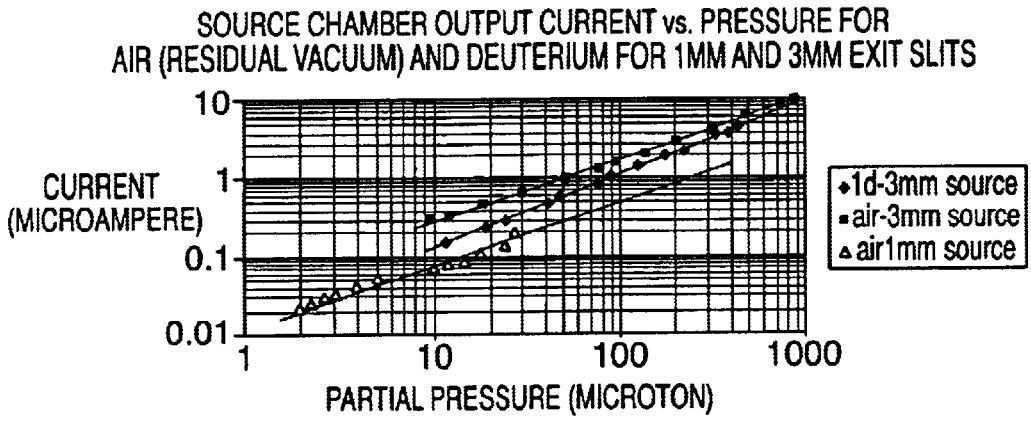
FIG. 3 is a graph showing current as a function of partial pressure for air and deuterium for 1 mm and 3 mm exit slits.

FIG. 3 illustrates source output characteristics for air and deuterium gas using 1 mm and 3 mm slit configurations. The source is shown to deliver microamperes of deuterium current on the $10^{-4}$ torr range.

The performance of typical electron bombardment sources compared with the invention at their operating conditions are shown in Table 1 below.

TABLE 1

| ELECTRON BOMBARDMENT SOURCE | LEYBOLD TYPE | VEECO | THE PRESENT INVENTION |
|---|---|---|---|
| Maximum Operating Pressure (Torr) | $2 \times 10^{-4}$ | $1 \times 10^{-4}$ | $3 \times 10^{-4}$ |
| Maximum Useful Current (Microampere) | 0.002 | 0.5 | 3.0 |

The term "maximum useful current" applies to operational use; that is, the Leybold type is typical for radio frequency mass spectrometers where the source aperture is 0.1 mm, the Veeco source is for a small radius of curvature magnetic mass spectrometer with a source aperture of 1 mm×10 mm. In both applications, there is a limitation caused by coulombic repulsion of ions in the mass selected beam, such that increase in source current through higher pressure does not result in significant increase in mass selected current. The present invention uses 3 mm or greater slit apertures which can deliver considerably more current and can operate at higher pressures because the resultant coulombic repulsion gives an acceptable dispersion phenomenon for the ion beam striking the target.

Ions produced by the source of the invention are accelerated by a negative voltage applied to the target. The source may be floated relative to the target if it is desired to have the target at ground potential. The target is preferably of the occluded type using a titanium or zirconium substrate whose characteristics are often attributed to the work of Shope.Shope, L.A., Theoretical Thick Target Yields for the DD and DT Reactions in the Metal Occluded Ti and Zr at energies up to 300 KeV. Sandia National Laboratory, SC-TM-66-247 (1966)

Figure 4:
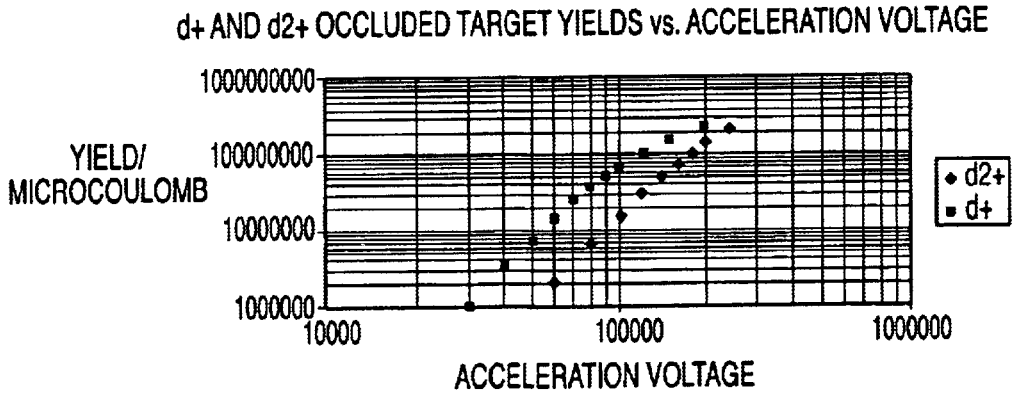
FIG. 4 is a graph showing yield (in microcoulombs as a function of acceleration voltage for $D^+$ and $D^{++}$ ions.

Following Shope's mathematical treatment FIG. 4 illustrates occluded target yields as a function of accelerating voltage derived from Shope's treatment of the DT reaction. At 1 microampere and 100 KeV, the production rate is $7\times10^{7}$ neutrons/sec for $D^{+}$ ions, and $1.6\times10^{7}$ neutrons/sec for $D^{++}$ ions.

In a field use configuration, the accelerating voltage of the invention is relatively low, 60 keV. The relative $D^{+}/D^{++}$ current, at 100 volts electron beam potential, is 0.1. Thus, the neutron output is $3\times10^{6}$ neutrons/sec @ 1 microampere, which is acceptable for many non-destructive analysis scenarios. For tumor treatment, the source is preferably operated at 3 microampere @ 130 keV delivering $2\times10^{8}$ neutrons/sec.

Figure 5:
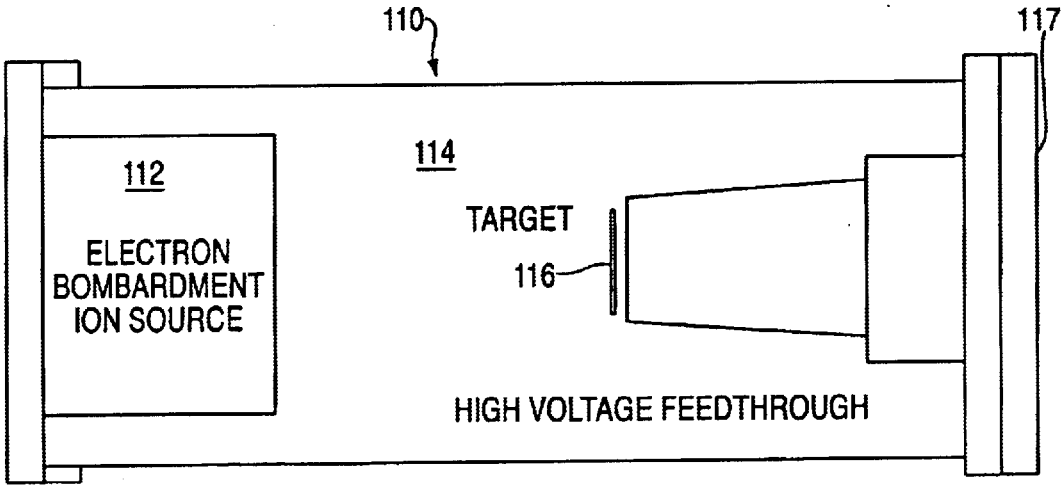
FIG. 5 is a high level schematic diagram of a first embodiment of a neutron generator according to the invention.

Two embodiments of neutron generator of the invention are disclosed. The first is a simple neutron generator where an ion beam is accelerated into a planar target. This is illustrated in FIG. 5. The generator 110 includes an electron bombardment ion source 112 as described above with reference to FIGS. 1 and 2, a high voltage feed through (accelerator) 114, and a target 116. Neutrons released by the target 116 are produced isotropically and easily penetrate the vacuum chamber walls. High voltage is fed to the target at the connector 117. The accelerator portion of the first neutron generator includes the exit slit of the ion source (not shown), a field free region to allow the ion beam to diverge to the appropriate size(when needed), and the planar target 116 at negative potential relative to the ion exit slit.

Figure 6:
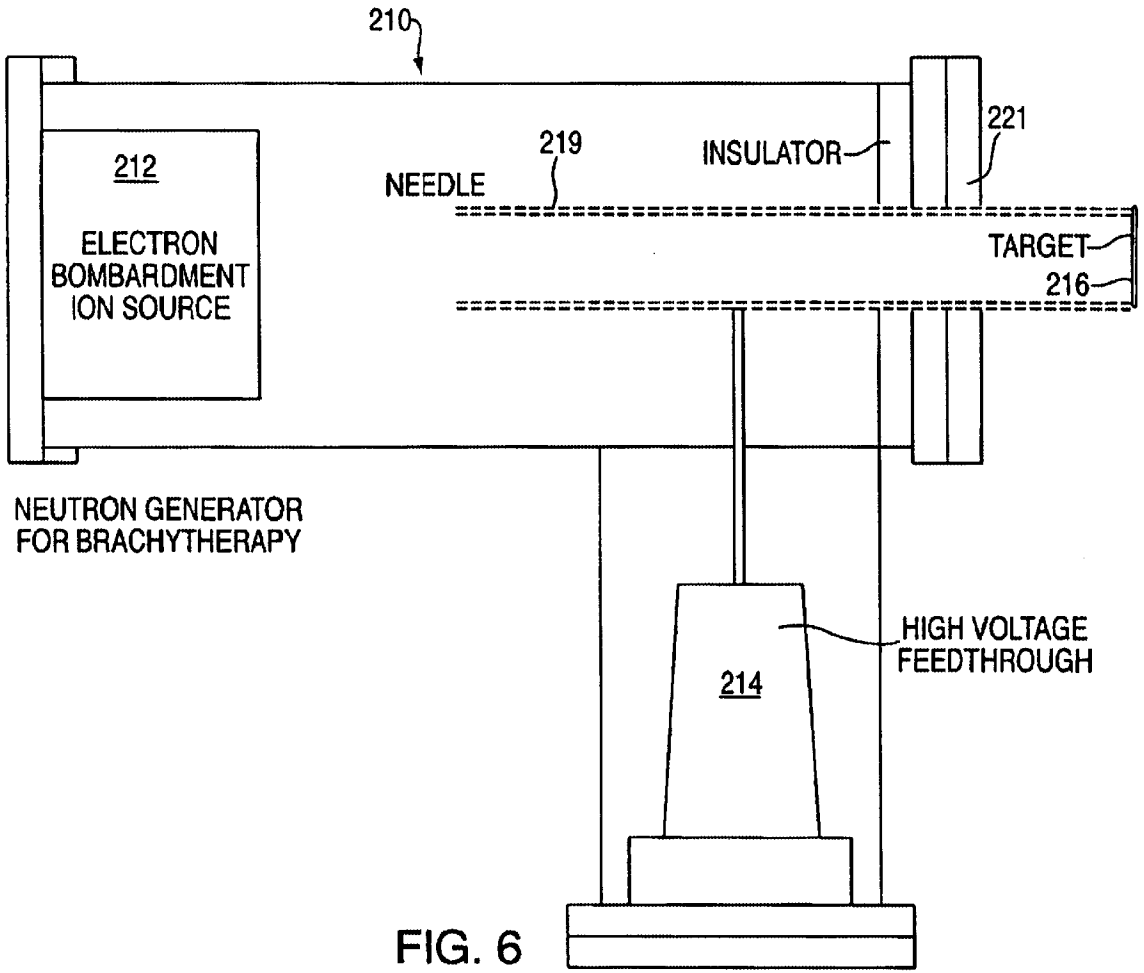
FIG. 6 is a high level schematic diagram of a second embodiment of a neutron generator according to the invention which is particularly suited for the treatment of tumors.

The second neutron generator 210 shown in FIG. 6 is specifically designed for tumor treatment. It includes an electron bombardment ion source 212 as described above with reference to FIGS. 1 and 2, a high voltage feed through (accelerator) 214, and a target 216. The target 216 is located at the end of a needle 219, a portion of which is coupled to the accelerator 214 and which is insulated by insulator 221. The beam is accelerated into the needle where the target is located at the end of the needle. The needle is a few cm diameter located at "L" cm from the source. The electric field lines tend to focus the source angular divergence at the entrance to the highly negative needle voltage in both the y and z directions. In the field free region inside the needle, the beam diverges until it reaches the target at the end of the needle. When the length of the needle is less than "L" cm, the beam is smaller than the source output x and y dimensions and the beam can be scanned along the target by relatively low voltage source steering plates. When the length of the needle is greater than "L", L can be chosen for a beam that fills the target; for a source exit slit of 3 mm×10 mm located 5 cm from the needle, an "L" length of 10 cm will reasonably illuminate a 1 cm radius target.

Figure 7:
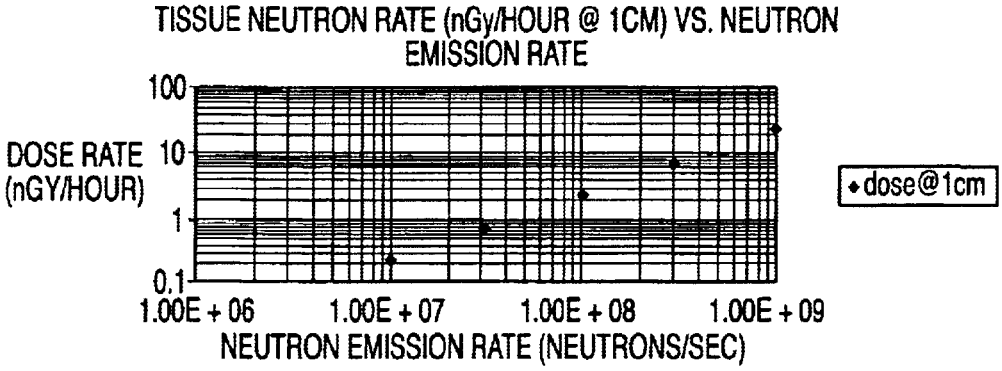
FIG. 7 is a graph illustrating dose rate as a function of neutron emission rate at one cm.

Neutron dose at 14.1 Mev may be computed from Monte Carlo techniques which, for tissue, give a typical value $8\times10^{-}$ ergs/gm/n/cm $^{2}$. For a point source, for a target yield of $10^{8}$ n/sec, the dose at 1 cm is calculated to be 2 Neutron Gy/hr, and for $7\times10^{8}$ n/sec, the dose at 1 cm is calculated to be 14 Neutron Gy/hr. A graph of neutron dose for a point source at lcm from the source is given by FIG. 7 which shows tissue dose rates a function of neutron emission rate at 1 cm from a point target.

Figure 8:
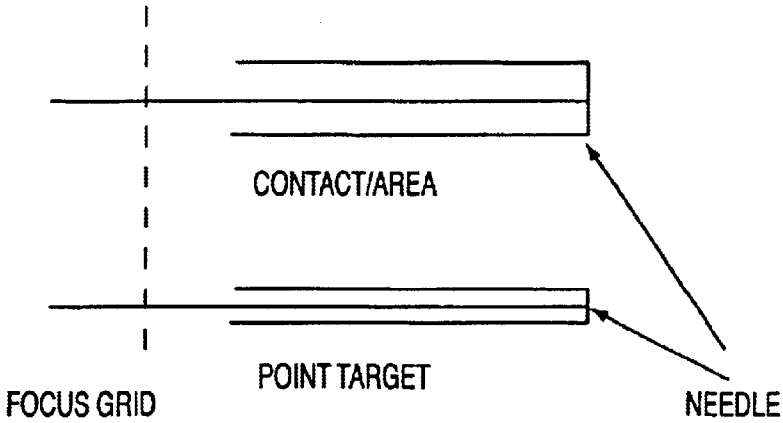
FIG. 8 is a high level schematic diagram illustrating different needle sizes and focusing grids according to the invention.

Using the neutron generator 210 of FIG. 6, tumor treatment can be accomplished in two target configurations which are illustrated in FIG. 8. The contact or area target (top of FIG. 8) is for skin tumors or tumors not deeply buried in the patient. The point target (bottom of FIG. 8) is for injecting the needle directly into the tumor either directly or through a surgically implanted tube: This configuration requires that the target is grounded and that the electron bombardment source is floated. The contact configuration may be accomplished with the needle at negative high voltage and an insulator of a few millimeters relative to a ground cap of a grounded external cylinder, or, by grounding the target and floating the source.

Figure 9:
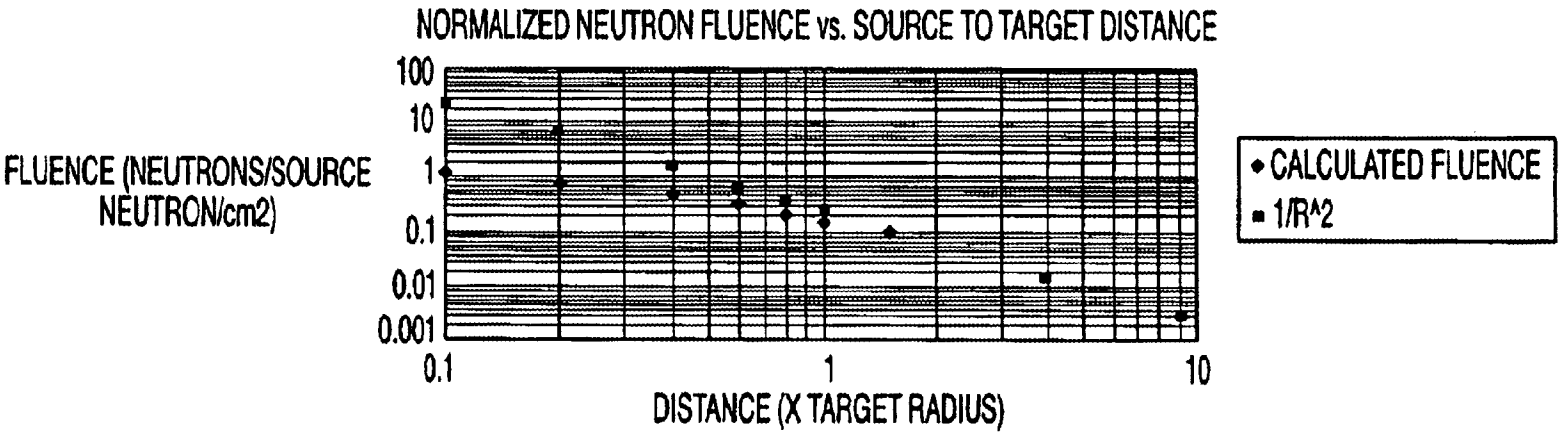
FIG. 9 is a graph illustrating neutron fluence as a function of source to target distance.

For uniform contact therapy, the radius of the target should be the radius of the tumor, although complicated tumor shapes can also be dealt with through steering of the beam to match the tumor configuration Alternatively, the target may be shaped to match the shape of the tumor. The calculated dose rate, as shown in FIG. 9, proportional to neutron fluence, is relatively flat relative to what is calculated for a point source ($1/R^2$) for about 0.5 target radii. Treatment depends on the tumor depth. If the depth is 0.1× tumor radius or so, the target should be a few 0.1× tumor radius from the tumor so that the dose in surrounding tissue receives the $1/R^2$ normally expected from brachytherapy. If the tumor depth is 0.5× tumor radius or so, then the target should be as close to the tumor as possible.

Figure 10:
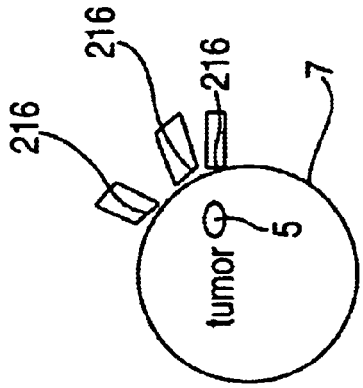
FIG. 10 is a high level schematic diagram illustrating a fractionated treatment method according to the invention.

An advantage of contact therapy over conventional seed brachytherapy implants for skin tumor treatment is that contact therapy does not requires surgery. Case studies indicate that all melanoma tumors were controlled by Cf-252, however, the surgical procedures required for installing tubes to position the seeds were significant. Contact therapy may also be used if the tumor is beneath the skin. Fractionated doses can be placed at different angles to the tumor. For example, FIG. 10 illustrates a tumor 5 in a patient's neck 7 treated with fractionated dose at different angles.

Contact therapy may also be used for treating tumors accessible through cavities, such as cervical cancer. Here the needle should be relatively small, less than a few cm, so that the dose can be delivered in a geometrically programmed manner, that is by moving the needle about the area. The geometric pattern of dose delivery should follow the normal prescriptions that have been developed over the years for brachytherapy.

The point target configuration (bottom of FIG. 8) is for directly applying the neutron target within the tumor. For a single dose application, lasting hours, the needle may be inserted into the tumor, or through a positioning needle.

Both brachytherapy and contact therapy achieve treatment by applying radioactive sources to the site of tumors. An advantage that these therapies have over beam therapy is that the usually isotropic source dose at the tumor results in dose fall off inversely with the square of the distance between healthy tissue and the source. Thus, healthy tissue receives less dose than the tumor. Neutron beam therapy, for which there is the most clinical data, tends to equally irradiate the healthy tissue and efforts to reduce the irradiation by shielding are difficult to accomplish because of the penetrating nature of the neutrons.

The neutron generator is capable of delivering on the order of $>10^8$ neutrons per second operating at 25 watts.

The present invention presents the idea of a simple micro-accelerator based neutron generator producing a single neutron spectral line at 14 Mev (without any significant gamma rays) with intensity programmable by beam current, and which clearly alleviates many of the radiation safety and handling issues. Accelerator based production facilities for neutron beam therapy have been relatively major investments. The D-T neutron generators constructed for beam therapy require massive collimation and shielding, and although the reaction produces copious amounts of 14-Mev neutrons, the production is nearly isotropic, so only a small fraction of the neutrons are available for treatment. The neutron generator according to the invention requires no collimation, minimal shielding, and the nearly isotropic neutron production rate is generally considered an advantage for treatment. The increase in 14 Mev neutron solid angle for brachytherapy over beam therapy can be 1,000 or more, and that allows the use of very different ion source and accelerator technology. Ion source current is reduced from milliamperes to microamperes, and resultant target power requirements are reduced from hundreds of watts to less than one watt.

There have been described and illustrated herein several embodiments of a neutron generator and methods for using it to treat tumors. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. A neutron generator for treating tumors, comprising:

a) an electron bombardment ion source having a gas-fillable ionization chamber defined by a repeller on one end of said ionization chamber and an anode defining an exit slit for extracting ions on an opposite end of said ionization chamber, and focusing apertures said ion source having means for generating an electron beam which creates ions by collision with a gas in said ionization chamber wherein said exit slit and said focusing apertures are each at least 3 mm in width;

b) a high voltage acceleration stage for accelerating said ions towards a target;

c) a hollow needle sealed on one end, wherein said sealed end may be brought at least into close proximity with the patient's body in the region of the tumor; and d) an occluded reaction target, which upon impact by said ions produces neutrons, wherein said reaction target is mounted within said hollow needle substantially towards said sealed end of said needle.

2. A neutron generator according to claim 1, wherein:

said neutron generator is capable of delivering on the order of $\geqq 10^8$ neutrons per second operating at 25 watts.

3. A neutron generator according to claim 1, wherein:

said electron bombardment source and said acceleration stage deliver an ion beam of a few tens of microamperes to said target operating at 75–500 KeV.

4. A neutron generator according to claim 1, further comprising:

d) means for steering a beam of ions produced by said electron bombardment source.

5. A neutron generator according to claim 4, wherein:

said means for steering is a rasterizing means.

6. A neutron generator according to claim 1, wherein:

said electron bombardment source includes a filament which operates at approximately 15 watts at approximately 3 volts.

7. A neutron generator according to claim 4, wherein:

said steering means operates at approximately ±10–100 volts.

8. A neutron generator according to claim 1, wherein:

said exit slit is located approximately 5 cm from said needle and said needle is approximately 10 cm long.

9. A neutron generator according to claim 1, wherein:

said generator produces 14.1 MeV neutrons.

10. A neutron generator according to claim 1, wherein said hollow needle is sustained at ground potential and said high voltage acceleration stage is coupled to said electron bombardment ion source and provides said electron bombardment ion source with positive potential.

* * * * *